US005892496A

United States Patent [19]

Wakeland

[11] Patent Number: 5,892,496

[45] Date of Patent: Apr. 6, 1999

[54] METHOD AND APPARATUS FOR DISPLAYING GRAYSCALE DATA ON A MONOCHROME GRAPHIC DISPLAY

[75] Inventor: Carl K. Wakeland, Austinn, Tex.

[73] Assignee: Advanced Micro Devices, Inc., Sunnyvale, Calif.

[21] Appl. No.: 576,107

[22] Filed: Dec. 21, 1995

[51] Int. Cl.[6] ..... G09G 5/10

[52] U.S. Cl. ..... 345/147; 358/534

[58] Field of Search ..... 345/147, 149, 345/150, 148, 153, 154, 132, 138, 112, 113; 358/534, 447, 536; 382/50

[56] References Cited

U.S. PATENT DOCUMENTS

| | | | |
|---|---|---|---|
| 4,155,095 | 5/1979 | Kirschner | 345/150 |
| 4,760,387 | 7/1988 | Ishii et al. | 340/716 |
| 5,041,823 | 8/1991 | Johnson et al. | 340/784 |
| 5,062,011 | 10/1991 | Farwell et al. | 358/236 |
| 5,068,649 | 11/1991 | Garrett | 340/793 |
| 5,119,086 | 6/1992 | Nishioka et al. | 340/793 |
| 5,122,783 | 6/1992 | Bassetti, Jr. | 340/701 |
| 5,185,602 | 2/1993 | Bassetti, Jr. et al. | 340/793 |
| 5,189,406 | 2/1993 | Humphries et al. | 345/147 |
| 5,196,839 | 3/1993 | Johary et al. | 340/793 |
| 5,245,328 | 9/1993 | Garrett | 345/149 |
| 5,252,959 | 10/1993 | Kono | 345/147 |
| 5,259,042 | 11/1993 | Matsuki et al. | 382/50 |
| 5,293,159 | 3/1994 | Bassetti, Jr. et al. | 345/149 |
| 5,298,915 | 3/1994 | Bassetti, Jr. | 345/149 |
| 5,307,083 | 4/1994 | Snodgrass et al. | 345/147 |
| 5,337,160 | 8/1994 | Jones | 358/447 |
| 5,337,408 | 8/1994 | Fung et al. | 395/162 |
| 5,341,228 | 8/1994 | Parker et al. | 358/534 |

*Primary Examiner*—Chanh Nguyen
*Assistant Examiner*—John Suraci
*Attorney, Agent, or Firm*—Skjerven, Morrill, MacPherson, Franklin & Friel LLP; Ken J. Koestner

[57] ABSTRACT

A time-domain graphic synthesis method and apparatus form M single-bit patterns of length N to convert multiple-bit grayscale pixel data into single-bit binary display signals. M designates the number of gray levels to be displayed. N specifies a selected pattern size for usage in converting gray levels into perceived grayscale pixel data and advantages are gained if N is defined to be a prime number. Each of the N-bit binary patterns identifies a particular gray shade and each pattern, by definition, includes a plurality of ones and zeros. The ratio of the number of ones in an N-bit pattern to the total number N defines a relative intensity for that N-bit pattern. The relative intensity is indicative of and corresponds to the particular gray shade. The M single-bit patterns of length N are applied to a display which stores multiple-bit grayscale pixel data so that the column location of a pixel is converted to modulo-N form to designate one of the N bits of the pattern. Furthermore, for successive rows of the display, the column location of a pattern is progressively shifted or rotated with respect to a pixel. The shifting is modulo-N shifting and the amount of shifting is selected so that all N column locations are selected for N successive rows of the display. By applying the N-bit patterns in this manner, processing of all elements of the display includes processing of a matrix of adjacent N×N-bit squares. Processing of consecutive time frames of the display also includes shifting or rotating on a frame-by-frame basis, generating a repetitive pattern of N frames.

24 Claims, 6 Drawing Sheets

METHOD AND APPARATUS FOR DISPLAYING GRAYSCALE DATA ON A MONOCHROME GRAPHIC DISPLAY

BACKGROUND OF THE INVENTION

1. Field of the Invention

The present invention relates to an apparatus and method for producing a perception of grayscale shading on a monochrome display. More specifically, the invention relates to a perceived grayscale shading apparatus and method which operates in the time domain to substantially avoid visual disturbances such as flicker, "swimming" and "movie-marquee effect".

2. Description of the Relevant Art

Many information systems and computer systems have multiple-bit grayscale graphic display capabilities in which each picture element (pixel) memory cell defined within the rows and columns of a two-dimensional display has a number of brightness levels. Many of these information systems and computer systems also utilize a monochrome graphic display that displays a single intensity graphic on a contrasting (black) background. For many applications and graphics, it is desirable to display a multiple gray shade graphic on the monochrome display in a manner which creates a perception of a grayscale graphic display.

Various techniques have been used to create this perception. In analog displays, gray levels are displayed by applying different voltage levels to the display. In other displays, pulse width modulation is used so that gray levels are furnished by varying the time for which a constant voltage is applied to a pixel. In still other displays, frame rate control techniques are utilized in which a graphic is displayed over several time frames during which a constant voltage may either be supplied or withheld. Gray scales are displayed by selectively supplying or withholding the constant voltage for each of the frames.

For example, Bassetti, Jr. et al. in U.S. Pat. No. 5,185,602 entitled "METHOD AND APPARATUS FOR PRODUCING PERCEPTION OF HIGH QUALITY GRAYSCALE SHADING ON DIGITALLY COMMANDED DISPLAYS", issued on Feb. 9, 1993, describes such a display technique. Here, the perception of grayscale shading on a digitally commanded display is produced by commanding pixels of the display with brightness-setting signals of differing average duty cycles. Brightness-setting signals having one brightness level associated with them are phase-shifted in relation to time and distributed to spaced-apart pixel locations at which one brightness level is to be produced. The energy of spatially-adjacent pixels is scattered in time and pixels which are energized at the same time are selected to be spatially scattered so as to avoid the perception of visual disturbances such as flickering and surface streaming.

Bassetti et al. utilize a signal synthesis technique in which grayscale waveform data is accessed and modulated with a phase signal synthesized from the grayscale data with the different phases spatially distributed in a phase pattern matrix. Accordingly, the grayscale data is manifest as a pattern of frames having an average duty cycle indicative of a gray shade.

In another example, Garrett J. H. in U.S. Pat. No. 5,068,649 entitled "METHOD AND APPARATUS FOR DISPLAYING DIFFERENT SHADES OF GRAY ON A LIQUID CRYSTAL DISPLAY", issued Nov. 26, 1991, teaches an alternative display technique. The system disclosed by Garrett furnishes a means for both spatially and temporally resolving the on/off states of a two-state display device to provide apparent shades of gray. Cycling between on and off states is not performed in a discernible pattern, but rather a pseudo-random pattern is utilized which repeats only after many cycles. Adjacent pixels, when selected to display the same shade of gray, do not cycle on and off in synchronization, but rather use out-of-phase cycling patterns. This spatial resolution reduces perceived flicker in the display and creates a more stable graphic.

The Garrett system uses predetermined patterns which repeat only after predetermined numbers of cycles to provide the gray scale. The pseudo-random pattern cycling is accomplished by "causing a predetermined skewing of each subsequently generated display signal having a pattern cycle for which the total number of display elements in a row is integrally divisible each time a bit of a respective display signal is provided for the last display element of a row" in accordance with Garrett's claim 1.

SUMMARY OF THE INVENTION

In accordance with the present invention, a time-domain graphic synthesis method and apparatus form M N-bit patterns to convert multiple-bit grayscale pixel data into single-bit binary display signals. M designates the number of frame rate-controlled gray levels to be expanded into an N×N square matrix for subsequent display. N specifies a selected pattern length for usage in converting gray levels into perceived grayscale pixel data. Each of the N-bit binary patterns identifies a particular gray shade and each pattern, by definition, includes a plurality of ones and zeros. The ratio of the number of ones in an N-bit pattern to the total number N defines a relative intensity for that N-bit pattern. The relative intensity is indicative of, and corresponds to, the particular gray shade. The M single-bit patterns of length N are applied to a display system, typically an LCD panel, which converts, collects and displays multiple-bit grayscale pixel data so that the column location of a pixel is converted to modulo-N form to designate one of the N bits of the pattern. Furthermore, for successive rows of the display system, the bit corresponding to one column location of a pattern is progressively shifted or rotated with respect to the pixel. The shifting is modulo-N shifting and the amount of shifting is selected so that all N column locations are selected for N successive rows of the display. By applying the M single-bit patterns of length N in this manner, processing of all elements of the display includes processing of a matrix of adjacent N×N-bit pixel squares. Processing of consecutive time frames of the display also includes shifting or rotating on a frame-by-frame basis, generating a repetitive pattern of N frames. Advantages are gained when the number N is defined to be a prime number.

In accordance with one embodiment of the invention, a display controller for converting multiple-bit grayscale pixels from a plurality of frames of a two-dimensional display into binary-valued pixels of a perceived grayscale display includes a pattern generator and an address generator. The pattern generator generates M single-bit patterns of length N where M defines a number of different gray level values encoded by the multiple-bit grayscale pixels. The address generator generates a modulo-N address which addresses the generated patterns in combination with a gray level value applied from the two-dimensional display to designate a binary value for application to the perceived grayscale display. The modulo-N address is an additive combination, modulo-N, of a first dimension designator of the two-dimensional display, a second dimension designator of the two-dimensional display and a frame designator of the plurality of frames.

In accordance with another embodiment of the invention, a method of converting multiple-bit grayscale pixel data from a plurality of frames of a two-dimensional display into binary-valued pixel data of a perceived grayscale display includes the steps of generating M single-bit patterns of length N and selecting a pattern of the generated M patterns and a bit within the pattern. M defines a number of different gray level values encoded by the multiple-bit grayscale pixels. N is a prime number. The selecting step includes the substeps of designating the patterns M in accordance with a gray level value applied from the two-dimensional display to designate a binary value for application to the perceived grayscale display and determining the bit of the N length patterns as an additive combination, modulo-N, of a first dimension designator of the two-dimensional display, a second dimension designator of the two-dimensional display and a frame designator of the plurality of frames.

In accordance with a further embodiment of the invention, a method of converting multiple-bit grayscale pixel data from a plurality of frames of a two-dimensional display into binary-valued pixel data of a two-dimensional perceived grayscale display includes the steps of segmenting the two-dimensional display into a plurality of adjacent square two-spatial dimensional square blocks having a selected first and second dimensional size number of pixels, organizing segmented display frames into a plurality of multiple-frame patterns in a time dimension and designating an element of the organized and segmented display frames in the first dimension, second dimension and time dimension. The designated element has a location corresponding to the designation in the first and second dimensions of the two-dimensional display and the two-dimensional perceived grayscale display. The method further includes the steps of progressively shifting an element designation in the first dimension for successive element designations in the second dimension, assigning a binary pixel value to an element according to position in the first dimension and according to multiple-bit grayscale value in the time dimension, and displaying the assigned binary pixel value at the location of the perceived grayscale display corresponding to the first and second dimensional designations of the element.

Numerous advantages are achieved by the disclosed method and apparatus. One advantage is that, in comparison to the system disclosed by Bassetti et al. in which grayscale data is manifest as a pattern of frames having an average duty cycle indicative of a gray shade, the disclosed method is a time domain method in which grayscale is demonstrated in a single frame having an average relative intensity indicative of a gray shade. Accordingly, in the disclosed system, the average number of pixels activated in any frame for a particular gray shade is intrinsically assured to be proportional to the applied gray level. Substantially the same amount of energy is intrinsically displayed in each frame. A further advantage is that, because the disclosed method is based in the time domain, a phase relationship between adjacent pixels need not be maintained so that many more different patterns may be utilized. These additional patterns may be selected to achieve advantages in other aspects of implementation such as subjective preference, computational facility, efficiency in circuit design and the like. Another advantage of the disclosed system with respect to the Bassetti et al. system is that less circuitry and storage is utilized in forming the displayed graphic since a plurality of phase signals need not be stored and displayed.

A further advantage of the disclosed system, in comparison to the system taught by Garrett, is that patterns applied to the display are flexibly selected to achieve optimum graphic quality without regard to whether the pattern cycle for which the total number of display elements in a row is integrally divisible. Another advantage of the disclosed system over the Garrett teaching is that, in the disclosed system, there is no need to modify the implementation of the method to accommodate different display panel sizes.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings.

DETAILED DESCRIPTION OF THE INVENTION

Figure 1:
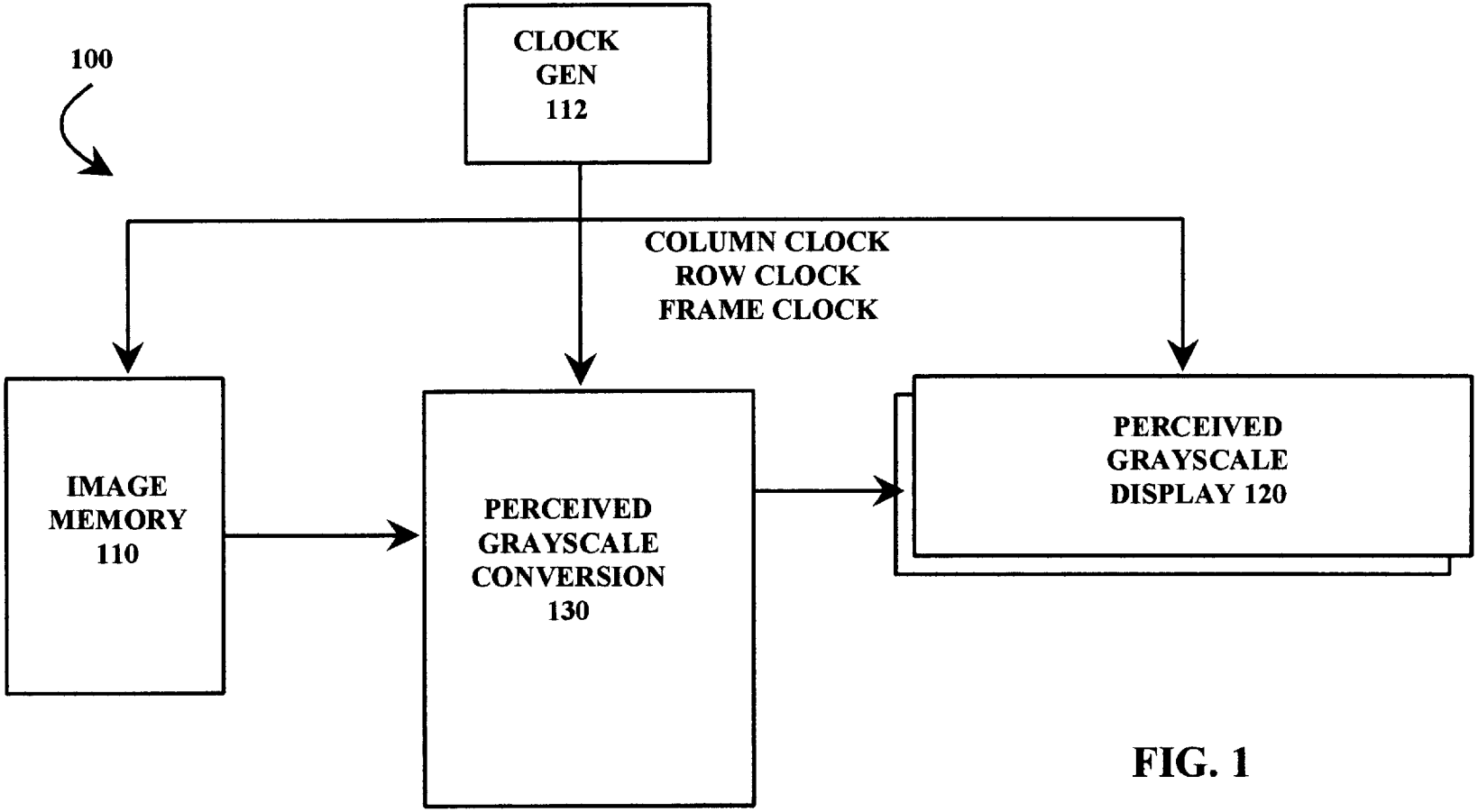
FIG. 1 is a highly schematic block diagram that illustrates a graphic display system in accordance with the present invention.

Referring to FIG. 1, a graphic display system 100 is illustrated, in which graphic data is furnished in the form of multiple-bit grayscale graphic pixel data and displayed on a two-dimensional binary display of single-bit pixels. Although the display typically is constructed only from single-bit display pixel elements, the display creates a perception of multiple gray levels. The graphic display system 100 includes a two-dimensional display 110 of multiple-bit memory elements such as random access memory (RAM) elements and a two-dimensional perceived grayscale display 120. A perceived grayscale conversion circuit 130 connects the graphic display system 110 and the perceived grayscale display 120. A clock generator 112 generates timing signals including a COLUMN CLOCK signal and a ROW CLOCK signal, each of which is supplied to the display 110, the perceived grayscale display 120 and the perceived grayscale conversion circuit 130 via various signal lines. Signals applied to the graphic display system 100 from external sources include a VERTICAL SYNC signal and a DISPLAY ENABLE signal, each of which is applied to the perceived grayscale display 120 and the perceived grayscale conversion circuit 130. The display 110 supplies a gray level signal to the perceived grayscale conversion circuit 130.

The graphic display system 100 utilizes a time-domain graphic synthesis method in which a plurality M single-bit patterns of length N are defined and employed to convert multiple-bit grayscale pixel data stored within the two-dimensional display 110 into single-bit binary display signals for display on the perceived grayscale display 120. The number M designates the number of gray levels to be displayed so that each of the N-bit binary patterns identifies a particular gray shade. Each pattern, by definition, includes a plurality of ones and zeros. The ratio of the number of ones in an N-bit pattern to the total number N defines a relative intensity for that N-bit pattern. TABLE I depicts an exemplary array showing a typical set of M single-bit patterns of length N, for example where N is equal to 17, for a grayscale display 110 that includes definition for 16 gray levels, levels 0 through 15.

TABLE I

| Gray Pattern Level N | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 1 | 0 | 0 | 1 | 0 | 0 | 0 | 0 |
| 2 | 0 | 0 | 0 | 0 | 1 | 0 | 1 | 0 | 1 | 0 | 0 | 0 | 0 | 0 | 0 | 0 | 0 |
| 3 | 1 | 0 | 1 | 0 | 0 | 0 | 0 | 1 | 0 | 0 | 0 | 0 | 1 | 0 | 0 | 0 | 0 |
| 4 | 1 | 0 | 0 | 0 | 0 | 0 | 0 | 1 | 1 | 1 | 0 | 0 | 0 | 0 | 0 | 0 | 1 |
| 5 | 0 | 1 | 0 | 1 | 0 | 1 | 0 | 1 | 0 | 1 | 0 | 0 | 0 | 0 | 0 | 0 | 1 |
| 6 | 1 | 1 | 1 | 0 | 0 | 0 | 0 | 0 | 0 | 0 | 0 | 0 | 0 | 1 | 1 | 1 | 1 |
| 7 | 0 | 0 | 1 | 1 | 1 | 0 | 0 | 0 | 1 | 1 | 1 | 0 | 0 | 0 | 1 | 1 | 0 |
| 8 | 1 | 1 | 0 | 0 | 0 | 1 | 1 | 1 | 0 | 0 | 0 | 1 | 1 | 1 | 0 | 0 | 1 |
| 9 | 0 | 0 | 0 | 1 | 1 | 1 | 1 | 1 | 1 | 1 | 1 | 1 | 1 | 0 | 0 | 0 | 0 |
| 10 | 1 | 0 | 1 | 0 | 1 | 0 | 1 | 0 | 1 | 0 | 1 | 1 | 1 | 1 | 1 | 1 | 0 |
| 11 | 0 | 1 | 1 | 1 | 1 | 1 | 1 | 0 | 0 | 0 | 1 | 1 | 1 | 1 | 1 | 1 | 0 |
| 12 | 0 | 1 | 0 | 1 | 1 | 1 | 1 | 0 | 1 | 1 | 1 | 1 | 0 | 1 | 1 | 1 | 1 |
| 13 | 1 | 1 | 1 | 1 | 0 | 1 | 0 | 1 | 0 | 1 | 1 | 1 | 1 | 1 | 1 | 1 | 1 |
| 14 | 1 | 1 | 1 | 1 | 1 | 1 | 1 | 1 | 1 | 0 | 1 | 1 | 0 | 1 | 1 | 1 | 1 |
| 15 | 1 | 1 | 1 | 1 | 1 | 1 | 1 | 1 | 1 | 1 | 1 | 1 | 1 | 1 | 1 | 1 | 1 |

The relative intensity value corresponds to a particular gray level or gray shade. The M single-bit patterns of length N are applied to the display 110 which stores multiple-bit grayscale pixel data so that the column location of a pixel is converted to modulo-N form to designate one of the N bits of the pattern. The number N specifies a selected pattern size for usage in converting gray levels into perceived grayscale pixel data. Specifically, for a row of the display 110, the columns are counted, modulo-N, to correlate a column number with the N-bit pattern. The gray level of pixel data at the corresponding row and column location is then used to select the pattern of the M single-bit patterns. Binary data in the M single-bit patterns of length N are accessed to determine whether a data one or data zero is to be displayed on the perceived grayscale display 120.

Figures 1, 2:
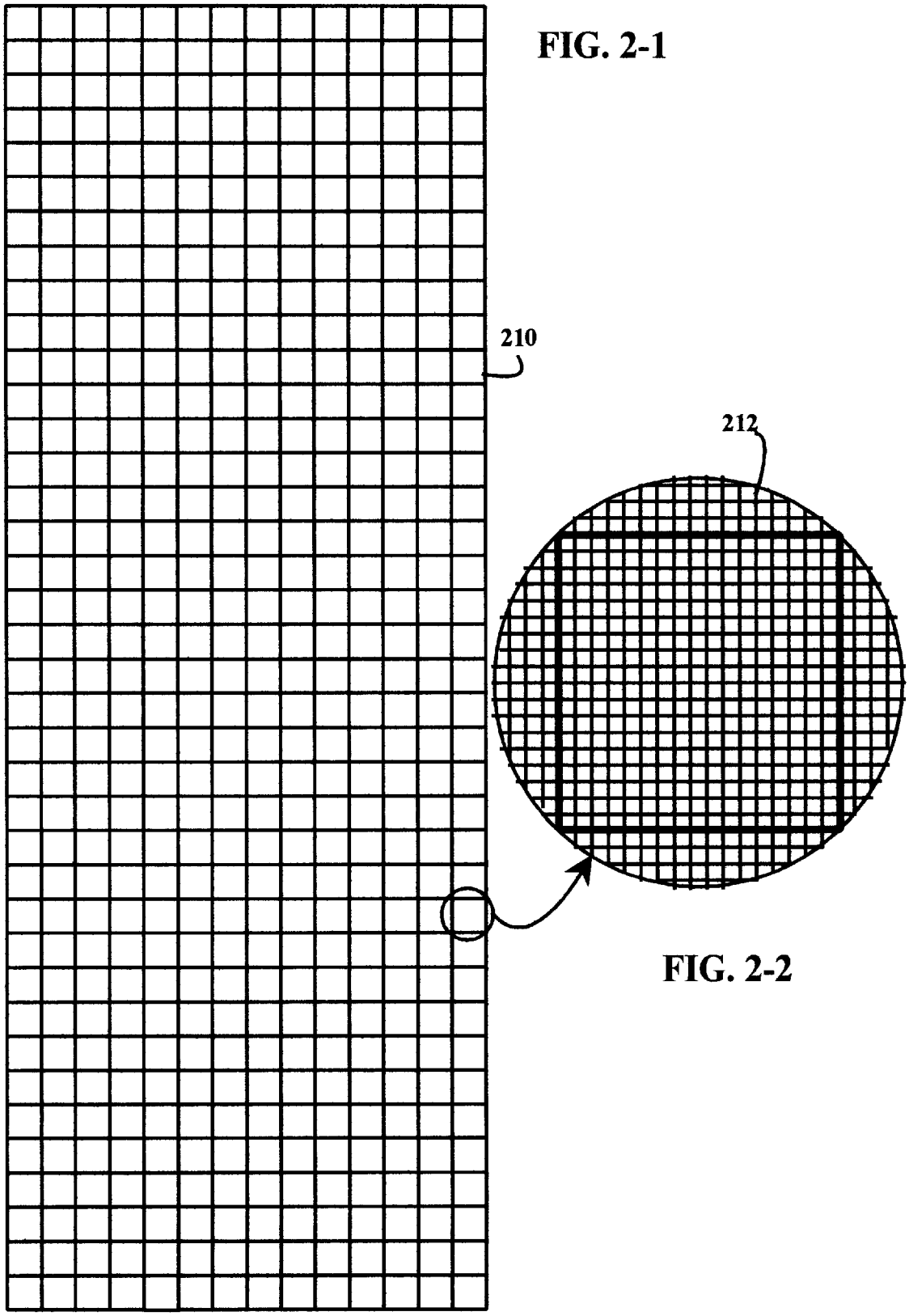
FIG. 2 is a pictorial view of a graphic display which is segmented into square regions for processing of data in a display.

The N-bit pattern is applied throughout the rows of the display 110, however the ordering of the pattern is rotated or shifted by a defined number of positions for each successive row of the display 110 and corresponding row of the perceived grayscale display 120. For successive rows of the display 110, the column location of a pattern is progressively shifted or rotated with respect to a pixel. The shifting is modulo-N shifting and the amount of shifting is selected so that all N column locations are selected for N successive rows of the display 110. By applying the N-bit patterns accordingly, all elements of the display 110 are processed in rectangular sections in a matrix of adjacent N×N-bit graphic squares. The display 110 is, in effect, segmented into N×N bit sections for processing. In one embodiment, the display 110 and perceived grayscale display 120 segment are segmented into a 17×17 pattern matrix. Referring to FIG. 2, a plurality of 17×17 pattern segments, for example segment 212, are shown in one 640×240 pixel subpanel 210 of a 640×480 display that includes two 640×240 pixel subpanels. Referring again to FIG. 1, the pattern matrix blocks are justified from the upper left corner of the display 110 and perceived grayscale display 120. Advantages are achieved when the number is defined to be an odd number. Patterns with an odd number of bits avoid DC buildup that occurs in a various display technologies, such as liquid crystal display (LCD) panels. Furthermore, advantages are gained when the number N is defined to be a prime number. One highly advantageous odd and prime number N-bit pattern is the illustrative 17-bit pattern shown in TABLE II, as follows.

TABLE II

| | | | | | | | | | | | | | | | | |
|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 17 |
| 14 | 15 | 16 | 17 | 1 | 2 | 3 | 4 | 5 | 6 | 7 | 8 | 9 | 10 | 11 | 12 | 13 |
| 10 | 11 | 12 | 13 | 14 | 15 | 16 | 17 | 1 | 2 | 3 | 4 | 5 | 6 | 7 | 8 | 9 |
| 6 | 7 | 8 | 9 | 10 | 11 | 12 | 13 | 14 | 15 | 16 | 17 | 1 | 2 | 3 | 4 | 5 |
| 2 | 3 | 4 | 5 | 6 | 7 | 8 | 9 | 10 | 11 | 12 | 13 | 14 | 15 | 16 | 17 | 1 |
| 15 | 16 | 17 | 1 | 2 | 3 | 4 | 5 | 6 | 7 | 8 | 9 | 10 | 11 | 12 | 13 | 14 |
| 11 | 12 | 13 | 14 | 15 | 16 | 17 | 1 | 2 | 3 | 4 | 5 | 6 | 7 | 8 | 9 | 10 |
| 7 | 8 | 9 | 10 | 11 | 12 | 13 | 14 | 15 | 16 | 17 | 1 | 2 | 3 | 4 | 5 | 6 |
| 3 | 4 | 5 | 6 | 7 | 8 | 9 | 10 | 11 | 12 | 13 | 14 | 15 | 16 | 17 | 1 | 2 |
| 16 | 17 | 1 | 2 | 3 | 4 | 5 | 6 | 7 | 8 | 9 | 10 | 11 | 12 | 13 | 14 | 15 |
| 12 | 13 | 14 | 15 | 16 | 17 | 1 | 2 | 3 | 4 | 5 | 6 | 7 | 8 | 9 | 10 | 11 |
| 8 | 9 | 10 | 11 | 12 | 13 | 14 | 15 | 16 | 17 | 1 | 2 | 3 | 4 | 5 | 6 | 7 |
| 4 | 5 | 6 | 7 | 8 | 9 | 10 | 11 | 12 | 13 | 14 | 15 | 16 | 17 | 1 | 2 | 3 |
| 17 | 1 | 2 | 3 | 4 | 5 | 6 | 7 | 8 | 9 | 10 | 11 | 12 | 13 | 14 | 15 | 16 |
| 13 | 14 | 15 | 16 | 17 | 1 | 2 | 3 | 4 | 5 | 6 | 7 | 8 | 9 | 10 | 11 | 15 |
| 9 | 10 | 11 | 12 | 13 | 14 | 15 | 16 | 17 | 1 | 2 | 3 | 4 | 5 | 6 | 7 | 11 |
| 5 | 6 | 7 | 8 | 9 | 10 | 11 | 12 | 13 | 14 | 15 | 16 | 17 | 1 | 2 | 3 | 7 |

The numbers shown in TABLE II illustrate the relative ordering of column locations in a series of rows of a corresponding display 110 and perceived grayscale display 120. Considering TABLE II in conjunction with the segmented display shown in FIG. 2, each 17×17 block uses a 17-bit pattern that is rotated four positions for each successive row. Because 17 is a prime number, 17 unique rotations are generated for 17 unique rotations of the pattern. Successive rows are shifted by four to allow a "knights move" placement shift which creates a maximum dispersal of DC buildup. Substantially optimal spatial dispersion is obtained if a 4-1 "knights move" data placement is used for each row. However, shift numbers, other than a knights move are also applicable. When the illustrative pattern shift is used, the pattern shift is dispersed a substantially optimal amount. Because 17 is a prime number, DC bias buildup is largely avoided. Furthermore, with a number N of 17, the pattern can be shifted in any amount (modulo-17) and, nevertheless, still generate 17 unique frame patterns in 17 consecutive rows.

Figure 3:
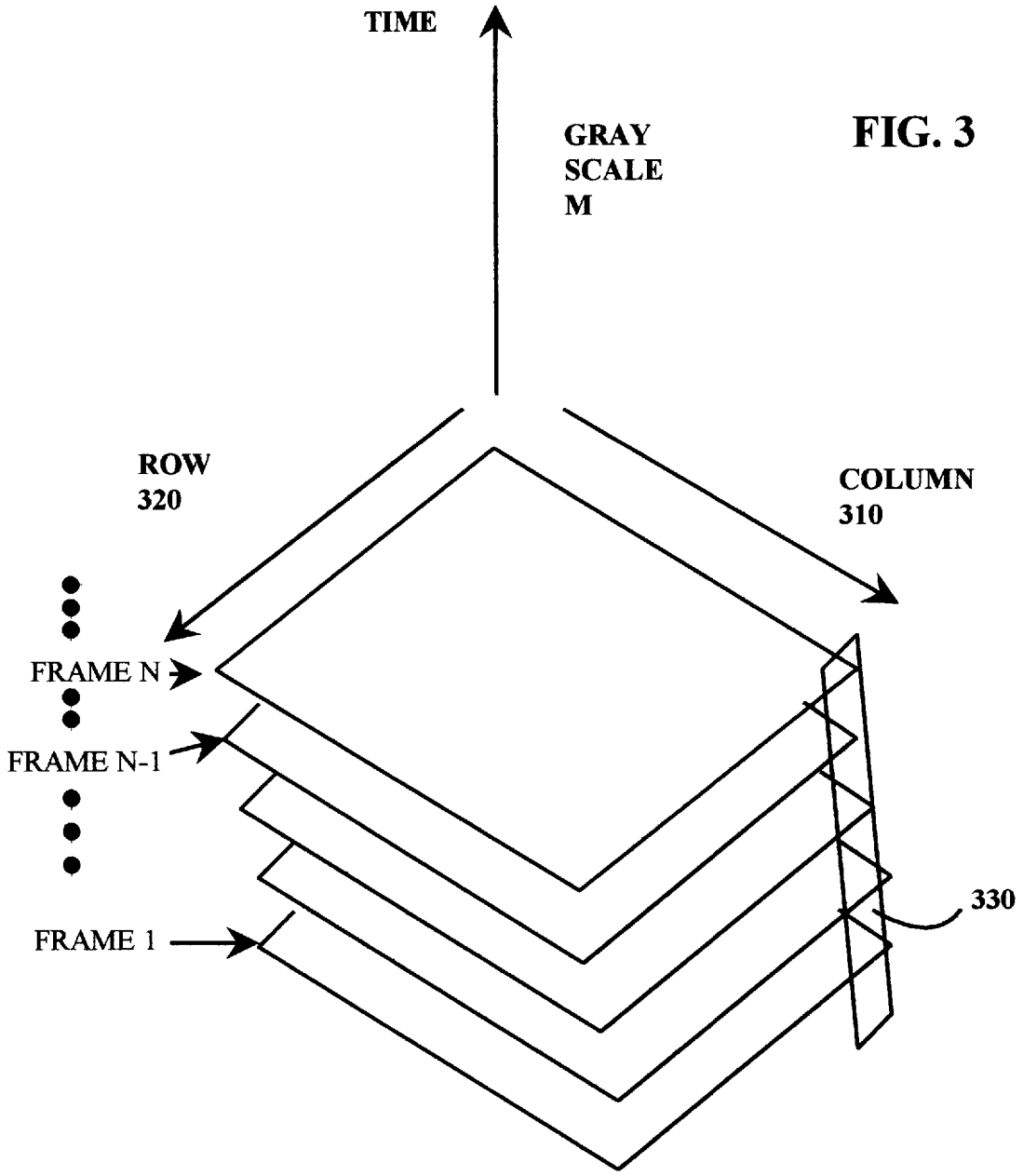
FIG. 3 is a pictorial three-dimensional view of a conceptual segmented region of the graphic display which illustrates application of a M single-bit patterns of length N to a display.

Referring to FIG. 3, a pictorial three-dimensional view of a conceptual segmented region 300 of the graphic display, which illustrates application of M single-bit patterns of length N to a display. The individual bits of a pattern generally corresponds to the column elements 310 of the region 300. The shifted or rotated patterns of length N generally correspond to rows 320 of the region 300. The M single-bit patterns of length N refer to gray shades of data in the display and generally corresponds to a conceptual mapping 330 of gray level to pixel value in accordance with a mapping such as that depicted in TABLE I.

Referring again to FIG. 1, the pattern shift initializes to zero at the top left corner of the display 110 and perceived grayscale display 120 for a first frame in a set of 17 consecutive frames. A row shift, usually four pixels as shown but alternative numbers are possible, is added, modulo-17, at the start of every successive row.

This shifting technique is further advantageous because it allows the entire display 110 and the perceived grayscale display 120 to be processed using a single 17-bit conversion circuit. This processing is achieved by passing the same 17-bit pattern, column-by-column, over an entire row. Subsequent rows are processed by shifting or rotating pointers to the 17-bit pattern, while continuing to process display data using the same conversion circuit elements. Accordingly, in a circuit implementation, the same basic hardware may be utilized to generate all perceived grayscale displays.

Processing of consecutive time frames of the display also includes shifting or rotating on a frame-by-frame basis, generating a repetitive pattern of N frames. A series of graphics are displayed in multiple time frames. The amount of frame shifting, in one embodiment, is determined by the gray level of the addressed element in the display 110. Typically, a row shift of 4 or 13 is suitable for all gray levels. Thus, in addition to spatial shifting and rotation of the N-bit pattern, ordering of the N-bit pattern is rotated or shifted by a defined number of positions for each successive frame. A row shift, usually four pixels as shown but alternative numbers are possible, is added modulo-17 at the start of every successive row. A frame shift, which is chosen to be optimal for each particular graphic shade or gray level, is added, modulo-N at the start of every frame.

In some embodiments of the graphic display system 100, M single-bit patterns of length N, such as the patterns shown in TABLE I, are stored as a dot pattern of M patterns of ones and zeros. Furthermore, a row shift amount is either stored or otherwise implemented in a circuit. A frame shift that is appropriate for each gray level is also stored. To reduce gate count of a circuit implementation, symmetry of the pattern is exploited so that circuits or memories for generating binary data for gray levels 0–7 are used, with inversion, to supply binary data for gray levels 8–15. For example, in TABLE I, data for gray level 0 is read from the first row and data for gray level 15 is also read from the first row but inverted. Similarly, pairs of gray levels 1 and 14, 2 and 13, 3 and 12, 4 and 11, 5 and 10, 6 and 9, and 7 and 8 use the same N-bit pattern.

Utilization of a 19-bit pattern is also suitable since the number 19 is odd and prime. One advantage of utilizing a 19-bit pattern is that, for a 16-gray level display, 3/19 is the lowest relative intensity. In contrast, the lowest relative intensity for a 17-bit pattern is 2/17. A higher relative intensity for the darkest gray shade results in a higher frequency for that gray shade, reducing flicker in a displayed graphic. However, a 17-bit pattern results in better pattern dispersal than a 19-bit pattern on row-to-row and frame-to-frame shifts because 19 mod 4 is greater than 17 mod 4. A further disadvantage of a 19-bit pattern is that additional gates are necessary in comparison to a 17-bit implementation.

In additional embodiments, a different prime number N for the N-bit patterns may be used. For example, 7, 11 and 23 bit patterns are suitable. A lower number N yields fewer gray levels.

Similarly, various different embodiments employ various selected row pattern shift and frame shift values. Typically, for a 17-bit pattern, a row shift of 4 or 13 is very suitable and highly advantageous to furnish a good pattern dispersal.

Generally, several guidelines are employed to evaluate implemented bit pattern sizes, row pattern shifting and frame pattern shifting. One guideline is that the number of bits in a pattern is sufficient to cover as many positions as possible before a "1" value is repetitively written to the display. For example, a five-bit pattern that is frame-shifted by three pixels results in a pattern of frames, with repeating "1" values illustrated in boldface, as is shown in TABLE III, as follows:

TABLE III

| | | | | |
|---|---|---|---|---|
| 1 | 0 | 0 | 1 | 0 |
| 0 | 1 | 0 | 1 | 0 |
| 0 | 1 | 0 | 0 | 1 |
| 0 | 0 | 1 | 0 | 1 |

By reducing the number of repeating "1" values, thereby achieving a good interlace pattern of "1" values and "0" values, a pleasing spatial distribution is achieved which reduces flicker in a graphic.

Another criterion is that the pattern have high dispersal so that a high gray level value does not persist for an excessively extended duration. For a particular bit in an N-bit pattern, each possible frame shift is typically attempted, a display generated and all the generated displays are analyzed to determine a suitable pattern.

Figure 4:
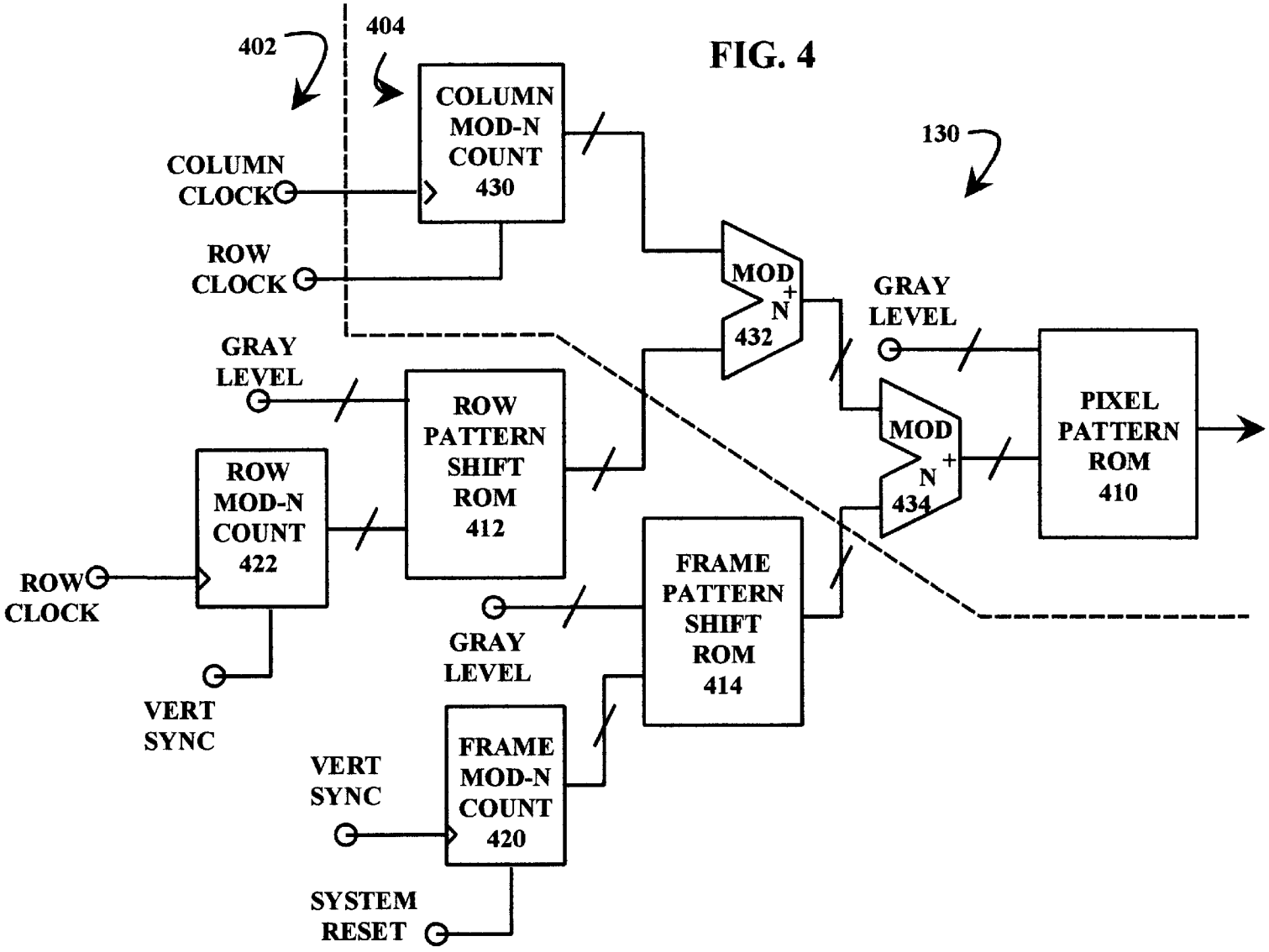
FIG. 4 is a schematic circuit diagram showing a perceived grayscale display circuit for converting multiple-bit grayscale graphic data from a display into single-bit binary display data that is perceived as having multiple gray levels by an observer.

Referring to FIG. 4, a schematic circuit diagram illustrates the perceived grayscale conversion circuit 130 which operates to receive a multiple-bit grayscale code from the display 110 and convert the grayscale code into a spatial and time pattern of single-bit pixels. The perceived grayscale conversion circuit 130 typically is intended for use with portable devices in which the screen is only capable of a small number of intensity levels. An example of such a screen is a liquid crystal display (LCD) screen commonly found in portable computer systems. In these screens, because individual pixels are only capable of a small number of intensity levels, various techniques have been developed to provide the appearance of grayscale for the individual pixels. Grayscale refers to an intensity level appearance of a pixel on a screen.

The perceived grayscale conversion circuit 130 combines pattern shift control circuitry 402 and pixel pattern control circuitry 404 which, in combination, include three read only memories (ROMs). These ROMs are, specifically, a pixel pattern ROM 410, a row pattern shift ROM 412 and a frame pattern shift ROM 414. The ROM memories are connected by various adder and counter circuits which generate address codes applied to the ROMs.

The pattern shift control circuitry 402 includes a frame modulo-N counter 420 which is clocked by the VERTICAL SYNC signal and is reset by a SYSTEM RESET signal. The frame modulo-N counter 420 generates an address input to the frame pattern shift ROM 414. The pattern shift control circuitry 402 also includes a row modulo-N counter 422 which is clocked by the row clock signal. The row modulo-N counter 422 furnishes an address input to the row pattern shift ROM 412. The row modulo-N counter 422 also has a reset terminal and receives the VERTICAL SYNC signal as a reset signal. The row pattern shift ROM 412 and frame pattern shift ROM 414 also receive a gray level signal as address input signals so that the amount of pattern shifting is defined as a function of the applied gray level.

The pixel pattern control circuitry 404 includes a column modulo-N counter 430, first and second modulo-N adders 432 and 434 and the pixel pattern ROM 410. The column modulo-N counter 430 and the first and second modulo-N adders 432 and 434 generate an address for the pixel pattern ROM 410. The ROW CLOCK signal resets the column modulo-N counter 430. The column modulo-N counter 430 is clocked by the COLUMN CLOCK signal and generates an input signal to the first modulo-N adder 432. The column modulo-N counter 430 also has a reset terminal which is connected to receive a ROW CLOCK signal. Alternatively, the column modulo-N counter 430 reset terminal is connected to receive a DISPLAY ENABLE signal. In addition to the output signal from the column modulo-N counter 430, the first modulo-N adder 432 receives, as an input signal, the output signal of the row pattern shift ROM 412. The first modulo-N adder 432 adds, modulo-N, the count from the column modulo-N counter 430 and data from the row pattern shift ROM 412 and applies the sum to an input terminal of the second modulo-N adder 434. Another input signal to the second modulo-N adder 434 is data from the frame pattern shift ROM 414. The second modulo-N adder 434 generates an address signal for application to the pixel pattern ROM 410. The pixel pattern ROM 410 also receives the gray level signal as an address input signal so that binary-valued ("on" or "off") pixel data is defined as a function of the applied gray level.

In operation, the pixel pattern ROM 410 stores N×M pixels, where N represents a repeating pattern size. In one embodiment, the repeating pattern size is equal to 17 pixels. For a pattern size of 17 pixels, a pixel shift amount furnished by the row pattern shift ROM 412 is four pixels encoded as a five-bit number. Several advantages are achieved when the repeating pattern size is chosen to be a prime number. One advantage is that, using a prime repeating pattern size, shifting a pattern N times creates N unique patterns. M represents the number of gray levels in the multiple-bit grayscale display and is equal to 16 in one embodiment. The repeating pattern size is generally unrelated to the screen size of the display but is justified to the upper left corner of the display. The perceived grayscale conversion circuit 130 is utilized with any size screen. Data is furnished from a multiple-bit pixel in the display 110 and converted to a two-level binary pixel bit, which is displayed on a memory in a position that corresponds to the position of the pixel in the display 110. The perceived grayscale conversion circuit 130 operates to convert a multiple-bit gray level value of an element in the display 110 to a binary value which is derived as a function of the spatial position of the element in the two-dimensional memory and further as a function of the gray level value. The resulting binary value is displayed on the perceived grayscale display 120 in a position that corresponds to the element position in the display 110.

The spatial position of an element in the display 110, specifically the spatial position as designated by the ROW CLOCK signal and the COLUMN CLOCK signal, controls the pixel pattern control circuitry 404 which responds to the spatial position by determining a binary pixel data value for display on the perceived grayscale display 120. Functionally, the row pattern shift ROM 412 furnishes a shifting operation for progressively shifting the spatial column position of an element for successive rows of elements. The frame pattern shift ROM 414 also supplies a shifting operation. However, the frame pattern shift ROM 414 shifts the pixel pattern position according to gray level value and as a function of time (frame) dimensional changes. The pattern shift control circuitry 404 modifies the pixel data as a dynamic pattern which provides the perceived impression of the gray shade or gray level. The pattern shift disperses the activation of individual pixels through time and spatial dimensions so that the pixels merge to provide the appearance of a continuous gray level. The actual row and frame shifting is empirically developed to supply a preferable aesthetically pleasing grayscale graphic. The preferable grayscale mapping is a mapping that generates the fewest noticeable artifacts on the display.

Figure 5:
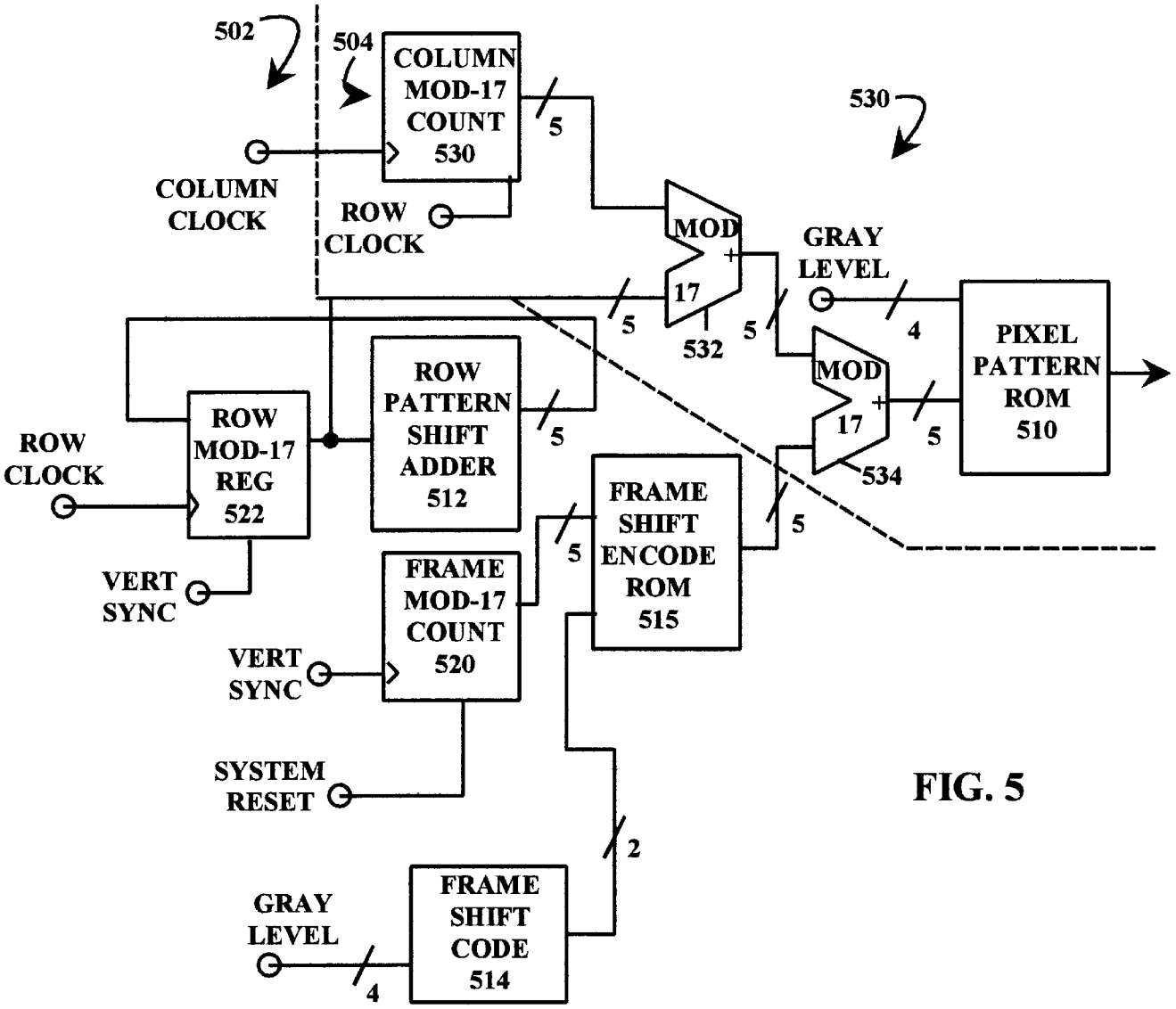
FIG. 5 is a schematic circuit diagram showing an alternative embodiment of a perceived grayscale display circuit.

Referring to FIG. 5, a schematic circuit diagram illustrates an alternative embodiment of a perceived grayscale conversion circuit 530, which is substantially similar to the embodiment of the perceived grayscale conversion circuit 130 except that the perceived grayscale conversion circuit 530 utilizes a specific 17-bit pattern and a 4-1 "Knight's move" row pattern shift so that the row pattern shift is fixed and not a function of gray level. In the perceived grayscale conversion circuit 530, a row pattern shift adder 512 replaces the row pattern shift ROM 412 of the perceived grayscale conversion circuit 130 and a frame shift code circuit 514 and a frame shift encode ROM 515 replace the frame pattern shift ROM 414 of the perceived grayscale conversion circuit 130.

The perceived grayscale conversion circuit 530 also includes a pattern shift control circuitry 502 and pixel pattern control circuitry 504 having two read only memories (ROMs). These ROMs are a pixel pattern ROM 510 and a frame shift encode ROM 415. The ROM memories are connected by adder and counter circuits which generate address codes applied to the ROMs.

Figure 6:
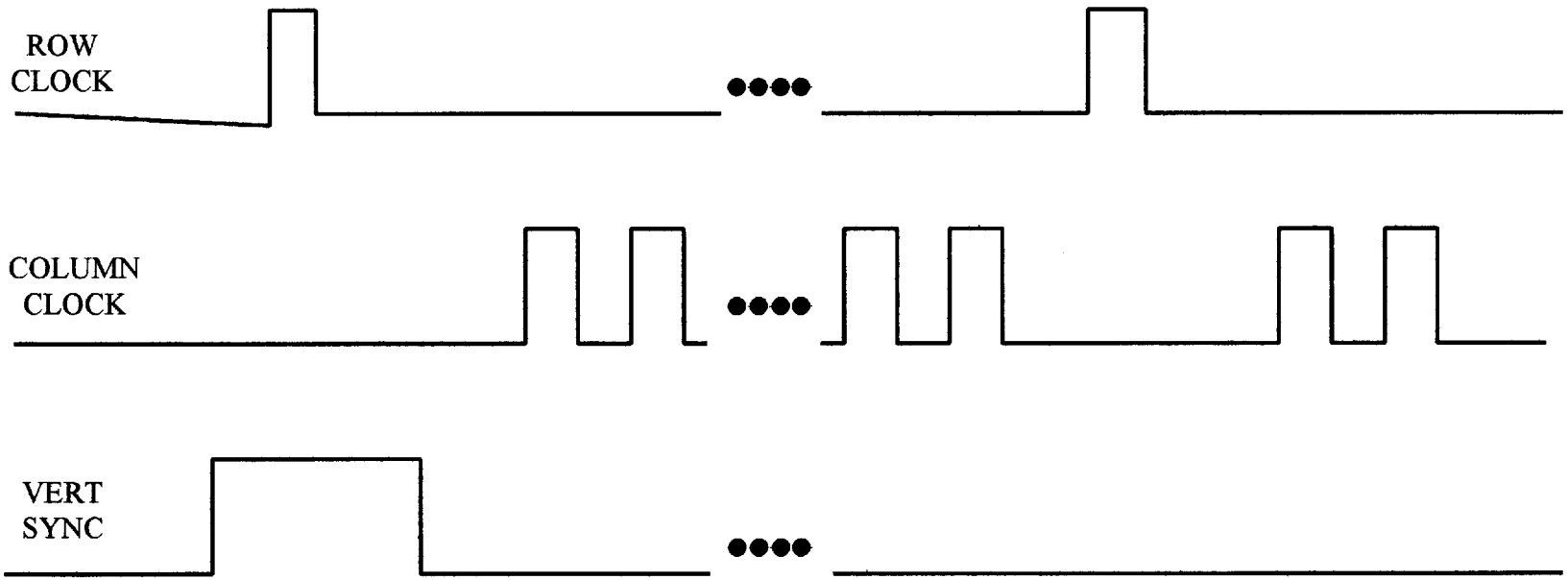
FIG. 6 is a timing diagram which illustrates signals for controlling the perceived grayscale display circuits shown in FIGS. 4 and 5.

Referring to FIG. 6 in conjunction with FIG. 5, the pattern shift control circuitry 502 is controlled by a ROW CLOCK signal 602, a COLUMN CLOCK signal 604 and a VERTICAL SYNC signal 606. The pattern shift control circuitry 502 includes a frame modulo-17 counter 520 which is clocked by the VERTICAL SYNC signal and generates an address input signal to the frame shift encode ROM 515. The frame shift encode ROM 515 receives a gray level signal via a frame shift code circuit 514 as address input signals so that the amount of pattern shifting is defined as a function of the applied gray level. The frame shift code circuit 514 specifies a frame shift code which corresponds to an optimal frame-to-frame pattern shift for each perceived gray scale so that flicker is reduced. TABLE IV illustrates one embodiment of a ROM implementation for encoding the frame shift encode ROM 515 and the frame shift code ROM 514. The frame shift code circuit 514 allows multiple gray levels to share the same frame shift value so that the amount of logic is reduced. The frame shift code circuit 514 receives a GRAY LEVEL signal and converts the gray level into a two-bit frame shift code in accordance with TABLE IV. The two-bit frame shift code is applied, in combination with the modulo-17 frame count, to the frame shift encode ROM 515. The frame shift encode ROM 515 generates the frame shift value for left shifting pixels from frame-to-frame.

TABLE IV

| Gray Level Signal | Pattern | Frame Shift (Left Rotation) | Frame Shift Code |
|---|---|---|---|
| 0 | 00000000000000000 | N.A. | — |
| 1 | 00000000010010000 | 6 | 0 |
| 2 | 00001010100000000 | 6 | 0 |
| 3 | 10100001000010000 | 14 | 1 |
| 4 | 10000001110000001 | 6 | 0 |
| 5 | 01010101010000001 | 5 | 2 |
| 6 | 11100000000001111 | 10 | 3 |
| 7 | 00111000111000110 | 14 | 1 |
| 8 | 11000111000111001 | 14 | 1 |
| 9 | 00011111111110000 | 10 | 3 |
| 10 | 10101010101111110 | 5 | 2 |
| 11 | 01111110001111110 | 6 | 0 |
| 12 | 01011110111101111 | 14 | 1 |
| 13 | 11110101011111111 | 6 | 0 |
| 14 | 11111111101101111 | 6 | 0 |
| 15 | 11111111111111111 | N.A. | — |

The pattern shift control circuitry 502 also includes a row modulo-17 register 522 which is clocked by the ROW CLOCK signal. The row modulo-17 register 522 supplies a row count signal to the row pattern adder 512. The row modulo-17 register 522 also has a reset terminal and receives the VERTICAL SYNC signal as a reset signal. The row pattern shift adder 512 has an input terminal that is connected to receive the row count signal from the row modulo-17 register 522. The row pattern shift adder 512 adds 13 to the count, modulo-17 and supplies the output sum signal to an input terminal of the row modulo-17 register 522 to initialize the row count.

The pixel pattern control circuitry 504 includes a column modulo-17 counter 530, first and second modulo-17 adders 532 and 534 and the pixel pattern ROM 510. The column modulo-17 counter 530 and the first and second modulo-17 adders 532 and 534 generate an address for the pixel pattern ROM 510. A ROW CLOCK signal resets the column modulo-17 counter 530. The column modulo-17 counter 530 is clocked by a COLUMN CLOCK signal and generates an input signal to the first modulo-17 adder 532. The column modulo-17 counter 530 also has a reset terminal which is connected to receive a ROW CLOCK signal. Alternatively, the column modulo-17 counter 530 reset terminal connected to receive a DISPLAY ENABLE signal. In addition to the output signal from the column modulo-17 counter 530, the first modulo-17 adder 532 receives, as an input signal, the output signal of the row pattern shift ROM 512. The first modulo-17 adder 532 adds, modulo-17, the count from the column modulo-17 counter 530 and data from the row pattern shift ROM 512 and applies the sum to an input terminal of the second modulo-17 adder 534. Another input signal to the second modulo-17 adder 534 is data from the frame pattern shift ROM 514. The second modulo-17 adder 534 generates an address signal for application to the pixel pattern ROM 510. The pixel pattern ROM 510 also receives the gray level signal as an address input signal so that binary-valued ("on" or "off") pixel data is defined as a function of the applied gray level.

While the invention has been described with reference to various embodiments, it will be understood that these embodiments are illustrative and that the scope of the invention is not limited to them. Many variations, modifications, additions and improvements of the embodiments described are possible. For example, the term "perceived grayscale" as applied in the description refer not only to perceived grayscale shading in monochrome displays but also to the perceived luminance of a colored region which is varied across a range of intensities. For purposes of clarity, the apparatus and method are described with reference to a particular display. The invention is not so limited and is applicable to all types of displays in which individual pixels are digitally controlled to display one of two output levels, an "on" level and an "off" level.

What is claimed is:

1. A display controller for converting multiple-bit grayscale pixels from a plurality of frames of a two-dimensional display into binary-valued pixels of a perceived grayscale display, the controller comprising:

a pattern generator generating M single-bit patterns of length N, M defining a number of different gray level values encoded by the multiple-bit grayscale pixels; and an address generator coupled to the pattern generator and generating a modulo-N address addressing the generated patterns in combination with a gray level value applied from the two-dimensional display to designate a binary value for application to the perceived grayscale display, the modulo-N address being an additive combination, modulo-N, of a first dimension designator of the two-dimensional display, a second dimension designator of the two-dimensional display and a frame designator of the plurality of frames.

2. A display controller according to claim 1 wherein the address generator comprises:

a first counter counting units of the first dimension of the display;

a second counter counting units of the second dimension of the display;

a second counter offset incrementor coupled to the second counter and incrementing the second counter by a selected value; and an adder coupled to the first counter and coupled to the second counter offset incrementor for adding the first counter units and the incremented second counter units.

3. A display controller according to claim 2 wherein the address generator further comprises:

a frame counter counting display frames; and a frame counter offset incrementor coupled to the frame counter and incrementing the frame counter by a selected value; wherein the adder is further coupled to the frame counter offset incrementor for further adding the incremented frame count.

4. A display controller according to claim 1 wherein the pattern generator comprises:

a memory including an N×M array having a plurality of gray level input lines coupled to the display, a plurality of address lines coupled to the address generator and a pixel data output line coupled to the perceived gray-scale display.

5. A display controller according to claim 4 wherein the pattern generator N×M array includes M single-bit patterns of length N having i ones and j zeros such that i/N is a relative intensity of a gray shade of the different gray level values.

6. A display controller according to claim 1, wherein the number, N, of single-bit patterns is an odd number.

7. A display controller according to claim 1, wherein the number, N, of single-bit patterns is a prime number.

8. A display controller according to claim 1, wherein the number, N, of single-bit patterns is 17 and a modulo-17 address generated by the address generator is an additive combination, modulo-17, of the first dimension designator and the second dimension designator shifted by four, modulo-17.

9. A display controller according to claim 1, wherein the number, N, of single-bit patterns is 19 and a modulo-19 address generated by the address generator is an additive combination, modulo-19, of the first dimension designator and the second dimension designator shifted by five, modulo-19.

10. A display controller for converting multiple-bit gray-scale pixels from a plurality of frames of a two-dimensional display into binary-valued pixels of a perceived grayscale display, the controller comprising:

a pattern generator generating M single-bit patterns of length N, M defining a number of different gray level values encoded by the multiple-bit grayscale pixels; and an address generator coupled to the pattern generator and generating a modulo-N address addressing the generated patterns in combination with a gray level value applied from the two-dimensional display to designate a binary value for application to the perceived gray-scale display the modulo-N address being an additive combination modulo-N, of a first dimension designator of the two-dimensional display, a second dimension designator of the two-dimensional display and a frame designator of the plurality of frames, wherein the address generator includes:

a modulo-N column counter having an input terminal coupled to a column clock line, a reset terminal and a plurality of output lines;

a modulo-N row counter having an input terminal coupled to a row clock line, a reset terminal coupled to a vertical sync pulse line and a plurality of output lines;

a row pattern shift memory having a plurality of input lines coupled to the modulo-N row counter supplying a row shift value and having a plurality of output lines;

a spatial graphic modulo-N adder having a first plurality of input lines coupled to the modulo-N column counter, a second plurality of input lines coupled to the row pattern shift memory and having a plurality of output lines, the spatial graphic modulo-N adder for adding, modulo-N, a column count from the modulo-N column counter and a pattern-shifted row count from the row pattern shift memory;

a modulo-N frame counter having an input terminal coupled to the vertical sync pulse line, a reset line coupled to a system reset line and having a plurality of output lines;

a frame pattern shift memory having a first plurality of input lines coupled to the modulo-N frame counter supplying a frame shift value, having a second plurality of input lines coupled to the display supplying a gray level value and having a plurality of output lines; and a frame modulo-N adder having a first plurality of input lines coupled to the spatial graphic modulo-N adder, a second plurality of input lines coupled to the frame pattern shift memory and having a plurality of output lines, the frame modulo-N adder for adding, modulo-N, the column count from the modulo-N column counter, the pattern-shifted row count from the row pattern shift memory and the pattern-shifted frame count from the frame pattern shift memory; and the pattern generator includes a memory having an N×M array having a plurality of gray level input lines coupled to the display, a plurality of address lines coupled to the frame modulo-N adder and a pixel data output line coupled to the perceived gray-scale display.

11. A display controller according to claim 6, wherein:

the plurality of input lines to the row pattern shift memory is a first plurality of input lines; and the row pattern shift memory has a second plurality of input lines coupled to the display supplying a gray level value.

12. A display controller according to claim 10, wherein the modulo-N column counter reset terminal is coupled to a row-clock line.

13. A display controller according to claim 10, wherein the modulo-N column counter reset terminal is coupled to a display-enable line.

14. A display controller for converting multiple-bit gray-scale pixels from a plurality of frames of a two-dimensional display into binary-valued pixels of a perceived grayscale display, the controller comprising:

a pattern generator generating M single-bit patterns of length N, M defining a number of different gray level values encoded by the multiple-bit grayscale pixels; and an address generator coupled to the pattern generator and generating a modulo-N address addressing the generated patterns in combination with a gray level value applied from the two-dimensional display to designate a binary value for application to the perceived gray-scale display, the modulo-N address being an additive combination, modulo-N, of a first dimension designator of the two-dimensional display, a second dimension designator of the two-dimensional display and a frame designator of the plurality of frames, wherein the address generator includes:

a modulo-N column counter having an input terminal coupled to a column clock line, a reset terminal coupled to a row clock line and a plurality of output lines;

a modulo-N row register having a input terminal coupled to a row clock line, a plurality of input lines, a reset terminal coupled to a vertical sync pulse line and a plurality of output lines;

a row pattern shift adder having a plurality of input lines coupled to the modulo-N row register supplying a row shift value and having a plurality of output lines coupled to the input lines of the modulo-N row register;

a spatial graphic modulo-N adder having a first plurality of input lines coupled to the output lines of the modulo-N column counter, a second plurality of input lines coupled to the output lines of the modulo-N row register and having a plurality of output lines, the spatial graphic modulo-N adder for adding, modulo-N, a column count from the modulo-N column counter and a pattern-shifted row count from the modulo-N row register;

a modulo-N frame counter having an input terminal coupled to the vertical sync pulse line, a reset line coupled to a system reset line and having a plurality of output lines;

a frame pattern shift memory having a first plurality of input lines coupled to the output lines of the modulo-N frame counter supplying a frame shift value, having a second plurality of input lines coupled to the display supplying a gray level value and having a plurality of output lines; and a frame modulo-N adder having a first plurality of input lines coupled to the output terminal of the spatial graphic modulo-N adder, a second plurality of input lines coupled to the frame pattern shift memory and having a plurality of output lines, the frame modulo-N adder for adding, modulo-N, the column count from the modulo-N column counter, the pattern-shifted row count from the row pattern shift memory and the pattern-shifted frame count from the frame pattern shift memory; and the pattern generator includes a memory having an N×M array having a plurality of gray level input lines coupled to the display, a plurality of address lines coupled to the frame modulo-N adder and a pixel data output line coupled to the perceived grayscale display.

15. A display controller according to claim 10, further comprising:

a frame shift encoder coupled between the gray level input lines and the frame pattern shift memory for encoding a gray level input signal so that the amount of pattern shifting is defined as a function of the applied gray level.

16. A method of converting multiple-bit grayscale pixel data from a plurality of frames of a two-dimensional display into binary-valued pixel data of a perceived grayscale display, the method comprising the steps of:

generating M single-bit patterns of length N, M defining a number of different gray level values encoded by the multiple-bit grayscale pixels and N being a prime number;

selecting a pattern of the generated M patterns and a bit of the selected pattern, the selecting step including the substeps of:

designating the pattern in accordance with a gray level value applied from the two-dimensional display to designate a binary value for application to the perceived grayscale display;

determining the bit of the selected pattern as an additive combination, modulo-N, of a first dimension designator of the two-dimensional display, a second dimension designator of the two-dimensional display and a frame designator of the plurality of frames.

17. A method according to claim 16 wherein the bit N determining step comprises the substeps of:

counting units of the first dimension of the display;

counting units of the second dimension of the display;

incrementing the second count by a selected value; and adding the first counter units and the incremented second count units.

18. A method according to claim 17 wherein the bit N determining step further comprises the substeps of:

counting display frames;

incrementing the frame count by a selected value; and adding the incremented frame count to the sum of the first count and the incremented second count.

19. A display system comprising:

a two-dimensional display having a plurality of multiple-bit grayscale pixels;

a two-dimensional perceived grayscale display having a plurality of binary-valued pixels;

a first dimension selector coupled to the display and the perceived grayscale display for addressing the display and the perceived grayscale display in a first dimension of the two dimensions;

a second dimension selector coupled to the display and the perceived grayscale display for addressing the display and the perceived grayscale display in a second dimension of the two dimensions;

a display controller coupled to the display and the perceived grayscale display for converting multiple-bit grayscale pixels from a plurality of frames of the display into binary-valued pixels of a perceived grayscale display, the display controller including:

a pattern generator generating M single-bit patterns of length N, M defining a number of different gray level values encoded by the multiple-bit grayscale pixels and N being a prime number; and a pointer generator coupled to the pattern generator and generating a modulo-N pointer operating in combination with a gray level value applied from the two-dimensional display to designate a binary value for application to the perceived grayscale display, the modulo-N pointer being an additive combination, modulo-N, of a first dimension designator of the two dimensional display, a second dimension designator of the two-dimensional display and a frame designator of the plurality of frames.

20. A method of converting multiple-bit grayscale pixel data from a plurality of frames of a two-dimensional display into binary-valued pixel data of a two-dimensional perceived grayscale display, the method comprising the steps of:

segmenting the two-dimensional display into a plurality of adjacent square two-spatial dimensional square blocks having a selected first and second dimensional number of pixels;

organizing segmented display frames into a plurality of multiple-frame patterns in a time dimension;

designating an element of the organized and segmented display frames in the first dimension, second dimension and time dimension, the designated element having a location corresponding to the designation in the first and second dimensions of the two-dimensional display and the two-dimensional perceived grayscale display;

progressively shifting an element designation in the first dimension for successive element designations in the second dimension;

assigning a binary pixel value to an element according to position in the first dimension and according to multiple-bit gray scale value in the time dimension; and displaying the assigned binary pixel value at the location of the perceived grayscale display corresponding to the first and second dimensional designations of the element.

21. A method according to claim 20 wherein the first and second dimensions of the two-spatial dimensional blocks have a prime number of pixels.

22. A method according to claim 20 wherein the time dimension of the multiple-frame pattern has a number of frames equal to the number of pixels in the first and second dimensions of the two-spatial dimensional blocks.

23. A method according to claim 20 wherein the first and second dimensions of the two-spatial dimensional blocks each have a length of 17 pixels element designations in the second dimension are progressively shifted four pixels modulo-17 for successive element designations in the second dimension.

24. A method according to claim 20 wherein the time dimension has a duration of 17 frames and the multiple-bit grayscale pixel data are defined by 16 gray levels.

* * * * *